United States Patent [19]

Yamashita

[11] Patent Number: 4,949,891

[45] Date of Patent: Aug. 21, 1990

[54] APPARATUS FOR FEEDING A LABEL-PRINTING TAPE

[75] Inventor: Kyouichi Yamashita, Yokohama, Japan

[73] Assignee: Koyou Jidouki Co., Ltd., Kanagawa, Japan

[21] Appl. No.: 786,138

[22] Filed: Oct. 7, 1985

Related U.S. Application Data

[63] Continuation of Ser. No. 577,917, Feb. 7, 1984, abandoned.

[30] Foreign Application Priority Data

Jul. 13, 1983 [JP] Japan ..... 58-126212

[51] Int. Cl.[5] ..... B65H 20/02; B65H 23/188

[52] U.S. Cl. ..... 226/30; 226/187; 226/188

[58] Field of Search ..... 192/84 A

[56] References Cited

U.S. PATENT DOCUMENTS

| | | | |
|---|---|---|---|
| 1,872,910 | 8/1932 | Doyle | 192/84 A |
| 2,002,374 | 5/1935 | King | 226/30 |
| 2,080,575 | 5/1937 | Perry | 226/30 |
| 2,628,556 | 2/1953 | Fay | 226/40 X |
| 3,028,064 | 4/1962 | Thurlings | 226/30 |
| 3,124,291 | 3/1964 | Beer | 226/178 |
| 3,157,259 | 11/1964 | Bialek | 192/84 A |
| 3,186,273 | 6/1965 | Tomberg | 226/31 X |
| 3,378,132 | 4/1968 | Good | 74/393 X |
| 3,385,497 | 5/1968 | Taraborrelli | 226/178 |
| 3,489,326 | 1/1970 | Singleton | 226/178 X |
| 3,768,714 | 10/1973 | Applequist et al. | 226/188 X |
| 3,768,715 | 10/1973 | Tout | 226/40 |
| 3,850,357 | 11/1974 | Lace | 226/178 |
| 4,221,317 | 9/1980 | Fukada et al. | 226/178 X |

FOREIGN PATENT DOCUMENTS

| | | | |
|---|---|---|---|
| 57-4846 | 1/1982 | Japan | 226/190 |

*Primary Examiner*—Harvey C. Hornsby
*Assistant Examiner*—Scott J. Haugland
*Attorney, Agent, or Firm*—Sughrue, Mion, Zinn, Macpeak & Seas

[57] ABSTRACT

An apparatus for selectively feeding tape having label patterns printed on it at one of two different speeds to maintain alignment of the label patterns with a downstream device such as a cutter for severing the tape between label patterns. Marks on the tape associated with the individual label patterns are monitored by a sensor to detect misalignment of the tape. The tape is fed between a driven feed drum and a spring biased pressure drum. The feed drum is mounted on a main shaft. A drive shaft extends parallel to the main shaft. A pair of gears are mounted on each of the shafts and each gear meshes with one of the gears on the other shaft to form two separate power transmission paths. The sizes of the gears are selected so that the gear ratios of the two power transmission paths are different. The gears on the main shaft are selectively fixed to the main shaft for rotation with it by electromagnetic clutches controlled by the sensor. The speed of the main shaft, the feed drum, and, thus, the tape is varied between the two speeds in response to the sensor output by disengagement of one of the clutches and engagement of the other.

9 Claims, 4 Drawing Sheets

APPARATUS FOR FEEDING A LABEL-PRINTING TAPE

This is a continuation of application Ser. No. 577,917, filed 2/7/84 now abandoned.

BACKGROUND OF THE INVENTION

This invention relates to an apparatus for feeding a tape having label patterns previously printed thereon to a cutting machine operating at a constant speed.

It is easy to manufacture apparatus for unwinding a roll of tape and for feeding the tape a constant speed for subsequent printing or cutting. Such a purpose can be achieved simply by drawing the tape by means of a constantly rotating drum or the like.

However, when a tape has a series of identical patterns previously printed thereon, for example, label patterns L as shown in FIG. 5, it is inadequate to draw the tape at a constant speed in order to feed the tape to a cutting or re-printing machine operating at a constant speed. If a tape is fed at a constant speed to a cutting machine operating at a constant speed, the tape is cut into pieces of the same length. However, the patterns printed on the tape are not exactly the same in length. As illustrated in FIG. 5, the length $l_1$ of an upstream label pattern L and the length $l_2$ of a downstream label pattern L positioned remotely from the former can possibly be somewhat different because of many factors including the accumulation of slight misalignment of the patterns on the tape during printing, the stretch of tape during high-speed feeding under high tension, the influence of humidity during feeding, the influence of humidity and aging during storage in the form of a roll, slippage occurring upon drawing out, the resistance of the roll being unwound, and the like.

For this reason, drawing and cutting the tape at a given length will result in the incremental misalignment of the actual cutting line from the desired cutting line between adjoining printed patterns, failing to cut the tape into pieces each having one complete pattern and useful as labels.

It is, therefore, an object of the present invention to provide a tape feeding apparatus capable of feeding a tape having patterns printed thereon to a constantly operating machine like a cutter at a controlled high speed such that the machine may receive the tape in a manner such that the patterns are exactly positioned with respect thereto.

It is another object of the present invention to provide a versatile tape feeding apparatus capable of handling a variety of tapes having printed patterns of different lengths or widths with minimal replacement of parts.

SUMMARY OF THE INVENTION

According to the present invention, there is provided an apparatus for feeding a tape having label patterns printed thereon, comprising a feed drum attached to a main shaft, a pressure drum held in contact with the feed drum to feed the tape therebetween, a drive shaft extending parallel to said main shaft, and means for transmitting the rotation of said drive shaft to said main shaft at selected one of different speed ratios.

BRIEF DESCRIPTION OF THE DRAWINGS

The above and other objects, features and advantages of the present invention will be better understood by reading the following description taken in conjunction with the accompanying drawings, in which.

DESCRIPTION OF THE PREFERRED EMBODIMENT

A. Overall Arrangement

Figure 1:
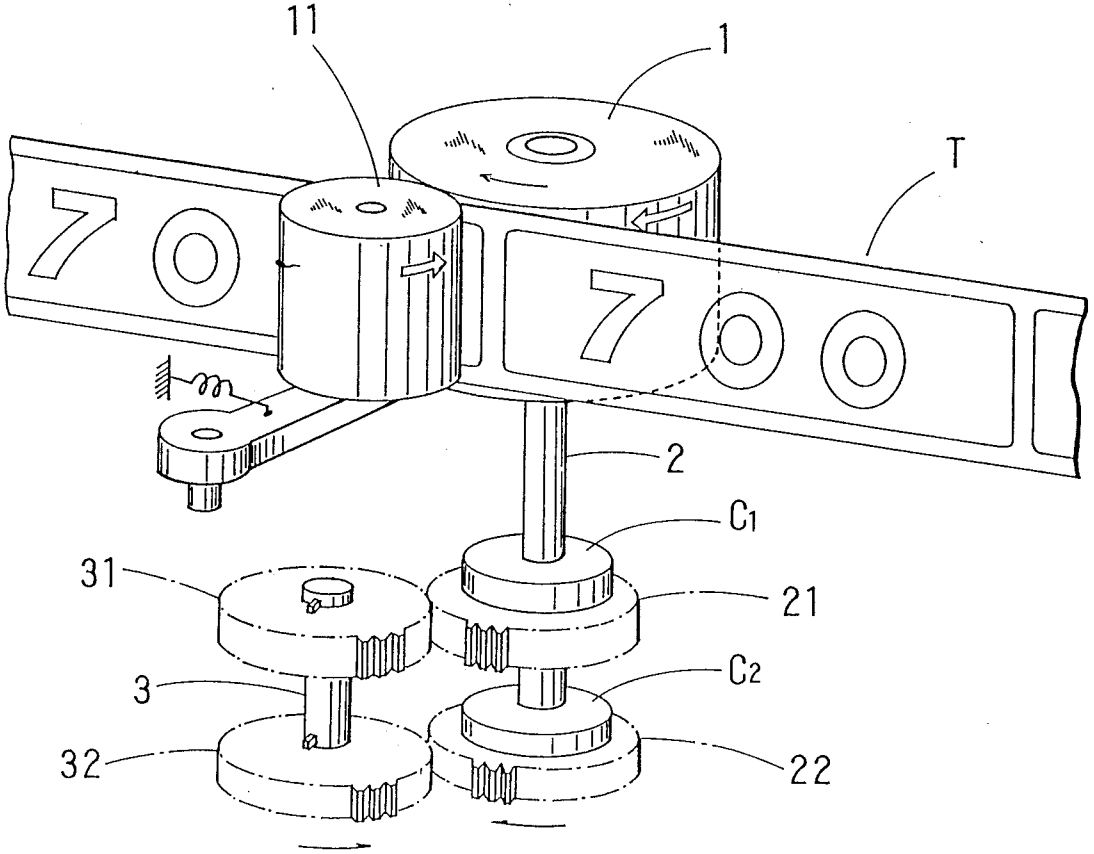
FIG. 1 is a perspective view of one preferred embodiment of the tape feeding apparatus according to the present invention.

As shown in FIG. 1, a tape T having patterns printed thereon is extended between the adjoining circumferential surfaces of a feed drum 1 and a pressure drum 11 and thereby frictionally transported in one direction.

B. Feed Drum

The feed drum at the center is removably attached to a main shaft 2 such that the drum may be replaced by another drum having a desired diameter.

The feed drum 1 is chosen such that its circumference is, for example, shorter than the length of the label pattern L printed on the tape T to be handled. More particularly, although the tape T is subject to local shrinkage and stretch, the outer circumference on the feed drum 1 is chosen to be slightly shorter than the expected minimal length of label patterns L. Such a choice is made so that tape feeding is continuously delayed decrementally, and when such delay or underfeeding exceeds a given value, tape feeding is accelerated to correct the cutting line. If it is desired to feed the tape incrementally and carry out cutting line correction when such incremental feeding or overfeeding exceeds a given value, then the drum 1 is chosen such that its outer circumference is slightly longer than the length of label patterns L.

The foregoing description is presented for the purpose of better understanding. The only requirement is to provide overfeeding or underfeeding. It is not necessarily required to set the outer circumference of the drum 1 to a multiple of the length of one label pattern, and the same purpose can be achieved by properly combining the drum with gears to be described latter.

It should be noted that when a different tape is to be handled, the feed drum 1 must be replaced by another drum.

C. Speed Regulating Gear Mechanism

The speed regulating gear mechanism comprises two sets of spur gears mounted on parallel shafts and meshing with each other and includes two speed regulation routes: an accelerating route and a decelerating route.

Figure 2:
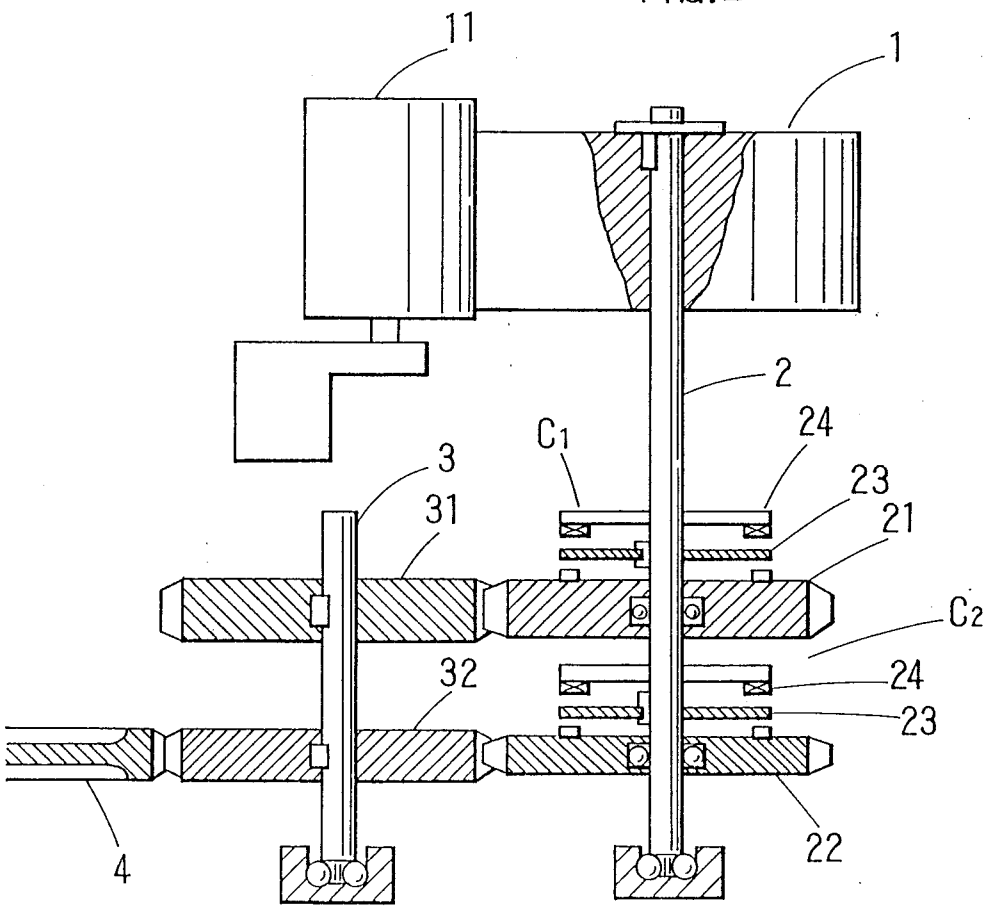
FIG. 2 is an elevational view, partially in cross section, of the tape feeding apparatus.

As shown in FIG. 2, the mechanism includes the main shaft 2 and a drive shaft 3 extending parallel to the main shaft. On the main shaft 2 having the feed drum 1 affixed to the top thereof are mounted for rotation decelerating and accelerating gears 21 and 22 in a non-keyed manner. The decelerating gear 21 has a slightly smaller number of teeth than the accelerating gear 22. Upper and lower drive gears 31 and 32 are mounted and keyed on the drive shaft 3. The upper drive gear 31 is in mesh with the decelerating gear 21 and the lower drive gear 32 is in mesh with the accelerating gear 22.

Provided that $i_2$ is a speed ratio given as the number of teeth of the accelerating gear 22 divided by that of the drive gear 32 and $i_1$ is a speed ratio given as the number of teeth of the decelerating gear 21 divided by that of the drive gear 31, the mechanism in this embodiment is characterized in that the speed ratio $i_1$ on the decelerating gear side is unity (1) and the speed ratio $i_2$ on the accelerating gear side is slightly larger than 1. For example, the upper drive gear 31 has 100 teeth, the decelerating gear 21 has 100 teeth, the lower drive gear 32 has 101 teeth, and the accelerating gear 22 has 99 teeth. In this manner, the numbers of teeth of these gears may be determined so as to meet the above requirement.

As a result, there are obtained two transmission routes, that is, an accelerating route of transmission from the upper drive gear 31 to the accelerating gear 22 and a decelerating route of transmission from the lower drive gear 32 to the decelerating gear 21.

D. Electromagnetic Clutch

The decelerating and accelerating gears 21 and 22 mesh with the drive gears 31 and 32 which always rotate at a constant speed with the drive shaft 3 independent of the main shaft 2. In order to transmit the torque of the drive gears 31 and 32 to the main shaft 2, the decelerating and accelerating gears 21 and 22 are provided with electromagnetic clutches C1 and C2, respectively, as shown in FIG. 2.

The electromagnetic clutch C1 comprises a clutch disc 23 mounted to the main shaft 2 above the decelerating gear 21 for free motion in an axial direction, but keyed against rotation. Above the clutch disc 23 is disposed an electromagnet 24 which is actuated upon receipt of a timing signal from a photoelectric tube to be described later.

The second electromagnetic clutch C2 comprises a clutch disc 23 and an electromagnet 24 arranged in the same manner as described for the first electromagnetic clutch C1.

The electromagnetic clutches C1 and C2 are constructed such that only when a respective electromagnet 24 receives a timing signal from a photoelectric tube R, the respective clutch disc 23 is pressed against the upper surface of the gear 21 or 22 to enable transmission of the torque of the drive gear 31 or 32 to the main shaft 2.

The electromagnetic clutches C1 and C2 on the main shaft 2 are constructed so as to be alternatively actuated in response to a timing signal from the photoelectric tube R. The electromagnetic clutch C2 associated with the accelerating gear 22 is released when the electromagnetic clutch C1 associated with the decelerating gear 21 is actuated, and vice versa. The electromagnetic clutches C1 and C2 can be released at the same time, but cannot be actuated at the same time.

E. Photoelectric Tube and Tape Mark

Marks M are printed in black on the back side of the tape T or at any suitable position on the tape T at the same time the label patterns are printed.

The pitch between two adjoining marks M is equal to the length of one label L printed on the tape T. The mark pitch is affected by the accumulation of printing errors and other factors mentioned above in the same manner as the label length because the marks and label patterns are printed at the same time.

The photoelectric tube R includes a light emitting section and a light detecting section built therein. A commercially available photoelectric tube may be used of the type in which the light emitting section emits light toward the tape, and when the emitted light impinges on a reflective region of the tape (outside the black marks), the light detecting section is turned on upon receipt of the reflected light, although other types of photoelectric tube may be used.

The photoelectric tube R is not operated continuously, but is designed so as to be operated exactly once per revolution of the drive gears 31 and 32. To this end, a timing switch (not shown) may be inserted between a power source and the photoelectric tube R. The timing switch which can be used herein may comprise a disc having a radial slit formed therein and a pair of light emitting and detecting phototubes opposed with respect to the disc. The rotary speed of the disc is set to be equal to the revolutions per minute of the drive shaft 3 such that the timing switch is closed once per revolution of the drive shaft 3 to actuate the photoelectric tube R.

The operation of the above-described system will be described below.

(a) Tape Setting

The tape T having label patterns and check marks M previously printed thereon is unwound from its roll, passed between the feed drum 1 and the pressure drum 11, and guided to a subsequent processing stations such as cutting and re-printing machines. In this condition, the position of a mark on the tape T and the starting position of the timing switch are adjusted such that the photoelectric tube R may align with a mark M, that is, the light emitted by the photoelectric tube R may impinge on a mark M.

(b) Normal Feeding

The feed drum 1 is attached to the main shaft 2 which is connected to the decelerating gear 21 by the actuated electromagnetic clutch C1. In the normal operation, the feed drum 1 continues to rotate with the decelerating gear 21 which continues to rotate with the mating drive gear 31. On the other hand, the accelerating gear 22, which continues to rotate with the mating drive gear 32, is independent of the main shaft 2 because the second electromagnetic clutch C2 is released. In the normal operation, the transmission route via the accelerating gear 22 is inoperative.

Figure 4:
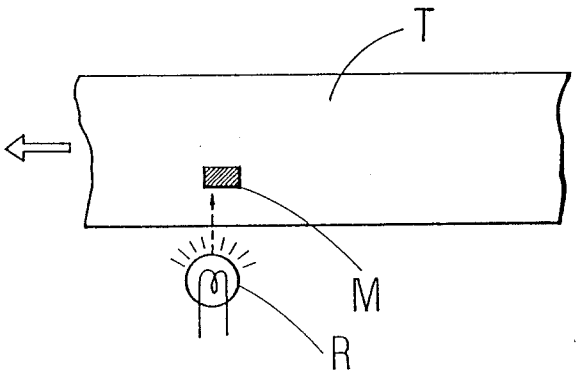
Figure 5:
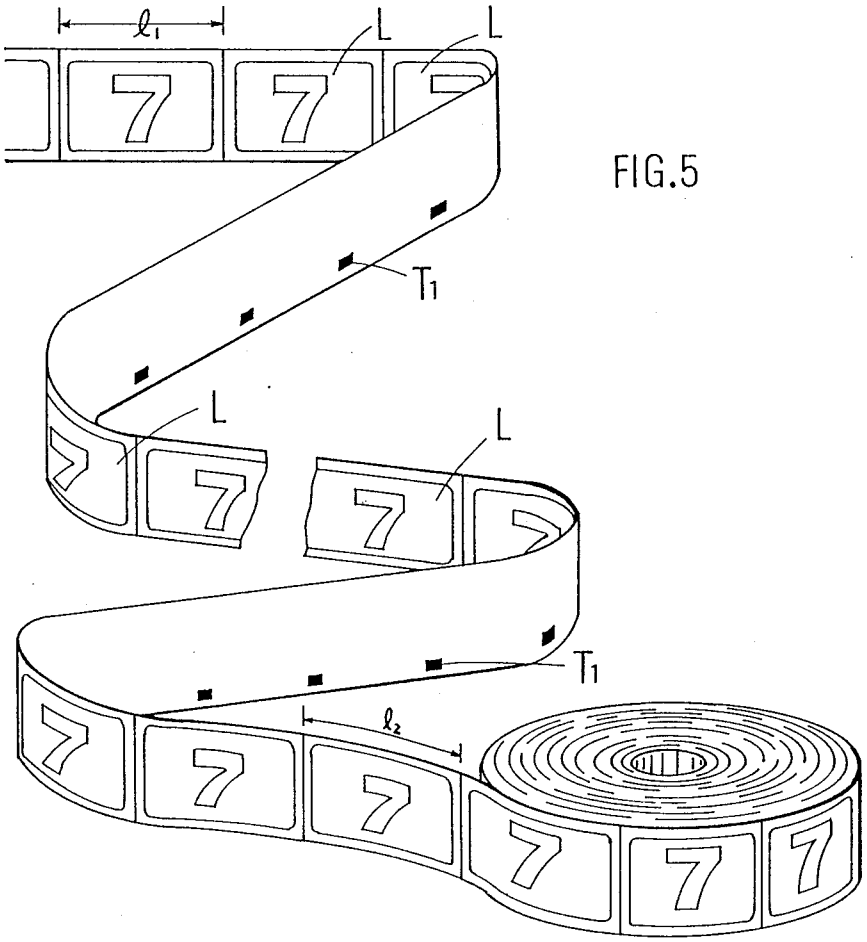
FIG. 5 illustrates a tape having label patterns printed thereon, the tape being unwound from its roll.

As the feed drum 1 has an outer circumference slightly shorter than the length of one label pattern L, one revolution of the feed drum 1 is slightly insufficient to feed the tape T by the length of one label. The photoelectric tube R is actuated once per revolution of the feed drum 1. Accordingly, with respect to the point of light emission, the time when marks M on the tape pass the position in alignment with the photoelectric tube R is continuously incrementally delayed. As long as the light emitted by the photoelectric tube R impinges on the tape within the confines of a mark M as shown in FIG. 4, the light is not reflected and no timing signal is generated.

(c) Tape Underfeeding

Figure 3:
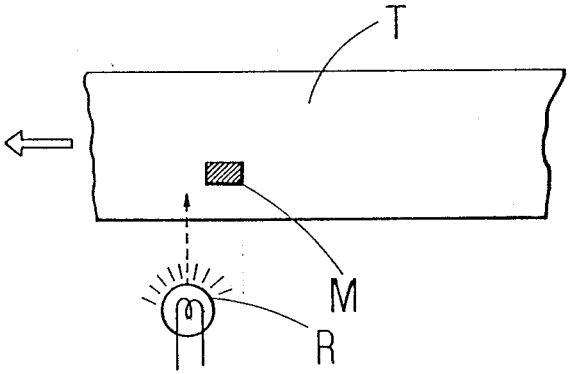
FIGS. 3 and 4 illustrate how a mark on the tape is positioned with respect to a photoelectric tube.

If the light emitted by the photoelectric tube R impinges on the tape outside the confines of a mark M as shown in FIG. 3, the photoelectric tube R instantaneously reacts to generate a timing signal. This timing signal is delivered to the electromagnetic clutch C2 to connect the clutch disc 23 to the accelerating gear 22 so that the torque of the drive gear 32 is transmitted to the main shaft 2 to rotate the main shaft at a slightly higher speed. At the same time, the electromagnetic clutch C1 associated with the decelerating gear 21 is released to interrupt transmission of the torque of the decelerating gear 21 to the main shaft 2.

Since the speed ratio associated with the accelerating gear 22 is slightly higher than the speed ratio associated with the decelerating gear 21, the speed of revolution of the main shaft 2 is increased and the feed speed of the tape T by the feed drum 1 is accordingly increased slightly.

(d) Tape Overfeeding

As a result of the increased feed speed of the tape T, the light beam emitted by the photoelectric tube R will impinge on the tape within the confines of a mark M again, and the photoelectric tube R will become nonreactive in the absence of reflected light. As a result, the electromagnetic clutch C2 associated with the accelerating gear 22 is released to render the accelerating gear 22 free of the main shaft 2. On the other hand, the electromagnetic clutch C1 associated with the decelerating gear 21 is actuated so that the torque of the decelerating gear 21 is transmitted to the main shaft 2 to rotate the feed drum 1. The tape T is thus fed at a speed corresponding to the slightly reduced circumferential speed of the feed drum 1.

With the above-described arrangement, the present invention provides the following benefits.

The feed speed of the tape is adjustable by alternatively connecting and disconnecting gears having different speed ratios depending on the position of a check mark on the tape relative to a photoelectric tube at the point of actuation of the photoelectric tube. The tape can be properly fed in a pattern pattern fashion by compensating any error of alignment of patterns printed on the tape, shrinkage and stretch of the tape itself, and the like.

The apparatus can handle a variety of tapes having printed thereon label patterns of different sizes simply by replacing the feed drum with another drum having a diameter corresponding to the length of a particular label pattern. Replacement of the feed drum only is only required to accommodate for a variety of tapes, eliminating the need for the replacement of many parts to various the size of label patterns on a tapes.

What is claimed is:

1. An apparatus for feeding a tape having label patterns printed thereon comprising; a feed drum attached to a main shaft; a pressure drum held in contact with said feed drum to feed the tape therebetween; a drive shaft extending parallel to said main shaft; a pair of clutches having fixed portions fixed to said main shaft; a first gear associated with a first of said clutches and made unitary with said main shaft when said first clutch is engaged; a second gear associated with a second of said clutches and made unitary with said main shaft when said second clutch is engaged; gear means mounted on said drive shaft for continuously driving both said first and second gears at respectively different speed ratios; and control means for selecting the engagement of either said first clutch or said second clutch.

2. The apparatus of claim 1, wherein one of said first and second gears comprises an accelerating gear, and the other of said first and second gears comprises a decelerating gear.

3. The apparatus of claim 2, wherein said gear means comprises first and second mating drive gears respectively in mesh with said first and second gears.

4. The tape feeding apparatus according to claim 3 wherein the speed ratio given as the number of teeth of the accelerating gear divided by that of the mating first drive gear is different from the speed ratio given as the number of teeth of the decelerating gear divided by that of the mating second drive gear.

5. The tape feeding apparatus according to claim 4 wherein the speed ratio associated with the accelerating gear is slightly higher than 1 and the speed ratio associated with the decelerating gear is equal to 1.

6. The apparatus of claim 1, wherein said tape includes a plurality of indicia thereon related to the positions of said label patterns, and wherein said control means includes means for detecting said indicia, and means for selecting the engagement of said first and second clutches in response to said detecting means.

7. The tape feeding apparatus according to claim 6 wherein said detecting means detects whether the tape is properly advanced by one pattern and generates a signal representative of improper tape feeding to paid clutches to actuate one clutch which has been released and to release the other clutch which has been actuated.

8. The tape feeding apparatus according to claim 7 wherein said detecting means comprises a photoelectric tube.

9. An apparatus for feeding a tape having label patterns printed thereon, comprising;

a feed drum attached to a main shaft;

a pressure drum held in contact with said feed drum to feed the tape therebetween;

a drive shaft extending parallel to said main shaft;

a pair of electromagnetic clutches having fixed portions fixed to main shaft;

a first gear associated with a first of said electromagnetic clutches and made unitary with said main shaft when said first electromagnetic clutch is engaged;

a second gear associated with a second of said electromagnetic clutches and made unitary with said main shaft when said second electromagnetic clutch is engaged;

gears mounted on said drive shaft for continuously driving both said first and second gears at respectively different speed ratios; and control means for selecting the engagement of either said first electromagnetic clutch or said second electromagnetic clutch.

* * * * *